United States Patent [19]

Vandemore

[11] Patent Number: 4,635,409

[45] Date of Patent: Jan. 13, 1987

[54] PLURAL-SECTION PITCH PAN

[75] Inventor: William J. Vandemore, St. Louis County, Mo.

[73] Assignee: Lucas Sales Company, Inc., St. Louis, Mo.

[21] Appl. No.: 776,839

[22] Filed: Sep. 17, 1985

[51] Int. Cl.[4] ..... E04B 1/36

[52] U.S. Cl. ..... 52/60; 52/219; 138/159

[58] Field of Search ..... 52/27, 58–61, 52/219; 98/58, 60, 67; 138/109, 155, 159, 160, 162

[56] References Cited

U.S. PATENT DOCUMENTS

| | | | |
|---|---|---|---|
| 3,023,032 | 2/1962 | Johnston et al. | 138/109 |
| 3,247,632 | 4/1966 | Bloxsom | 52/58 |
| 3,838,544 | 10/1974 | Hindall | 52/60 |
| 4,023,374 | 5/1977 | Colbert | 138/159 |

FOREIGN PATENT DOCUMENTS

| | | | |
|---|---|---|---|
| 2951275 | 7/1981 | Fed. Rep. of Germany | 52/58 |
| 2443542 | 8/1980 | France . | |

*Primary Examiner*—John E. Murtagh
*Assistant Examiner*—Andrew Joseph Rudy
*Attorney, Agent, or Firm*—Rey Eilers

[57] ABSTRACT

The present invention provides a pitch pan with just two J-shaped sections. The long leg of one J-shaped section is aligned with the short leg of the other J-shaped section, and vice versa; and the legs of the two J-shaped sections are provided with positioning surfaces which permit the long and short legs of the J-shaped sections to be shifted relative to each other to define adjustable-length walls at opposite sides of a filler-receiving recess. That two-section pitch pan is covered with water-impervious skirting before it is delivered to the job site. All an installer need do is to align the two sections of that pitch pan, secure them to each other and to the roof with fasteners, use a cement or adhesive to seal the skirting of those sections to the roof, use a cement or adhesive to seal an overskirt in position at each of the two sides of the pitch pan where the skirtings of the two sections confront each other, and then fill the filler-receiving recess defined by that pitch pan.

12 Claims, 12 Drawing Figures

PLURAL-SECTION PITCH PAN

To provide a water-tight roof for a building, it is necessary to provide a water-impervious flashing or filling around each and every object that passes upwardly through that roof. In those instances where such an object is of substantially constant cross-section and has its upper end free, it is possible to telescope a skirted flashing member over that object and then seal the skirt of that flashing member to the surface of the roof. However, where such an object does not have a substantially constant cross-section or where it is connected to a piece of equipment that will prevent the telescoping of a skirted flashing member over that object's upper end, it is customary to provide a plural-section pitch pan which can be disposed adjacent that object to define a filler-receiving recess. Some plural-section pitch pans are formed from four L-shaped sections which are capable of being interfitted to define the four corners and four walls of a filler-receiving recess. The walls and skirts of the adjacent L-shaped sections of those pitch pans lap each other whenever those sections are assembled on the roof to define a filler-receiving recess; and, where a portion of the skirt of each of those L-shaped sections is relieved to accomodate a portion of the skirt of an adjacent L-shaped section, relatively-large gaps can result beneath the relieved portions of the skirts of two or more of the L-shaped portions whenever those L-shaped portions are not in fully-lapped engagement. Also, the use of a four-section pitch pan requires the use of at least four fasteners to secure that pitch pan to the roof, requires a number of adjustments in the relative positions of those four sections to make sure that those sections provide a filling-receiving recess of the desired size and shape, and can require the use of four or more fasteners to fix the relative adjusted positions of the four sections. It would be desirable to provide a pitch pan which had fewer than four sections, and which did not require any portions of the skirts of adjacent sections to overlap each other. The present invention provides such a pitch pan by utilizing just two J-shaped sections. The long leg of one J-shaped section is aligned with the short leg of the other J-shaped section, and vice versa, and the legs of the two J-shaped sections are provided with positioning surfaces which will permit the long and short legs of the J-shaped sections to be shifted relative to each other to define adjustable-length walls at opposite sides of a filler-receiving recess. In using the two-section pitch pan of the present invention, an installer need only align the short and long legs of one section with the long and short legs, respectively, of the other section, and then secure those sections to each other and to the roof. As a result, that two-section pitch pan is easier to handle and to install, and it also can be sturdier, than a four-section pitch pan. It is, therefore, an object of the present invention to provide a pitch pan that has two J-shaped sections with positioning surfaces on the long and short legs thereof which enable that pitch pan to have adjustable-length walls at the opposite sides of a filler-receiving recess.

In providing a water-tight roof, it is desirable to completely cover that roof with a substantially constant-thickness, waterproof membrane or layer, and to effectively cement or seal all joints in that membrane or layer. As a result, where objects pass upwardly through a roof, it is customary to provide skirted flashings or pitch pans which can surround those objects. Those pitch pans will be suitably secured to the roof; and they should be covered with a material that is the same as, or is similar to, the material of the membrane or layer—so a fully compatible, completely sealed membrane or layer is provided for the roof. However, installers of roofs have experienced considerable difficulty in covering pitch pans with materials which are the same as, or are similar to, the materials that are used to cover the roofs. For example, the work of covering those pitch pans must be done at roof level, and hence requires the workmen to do the covering work while in kneeling or stooping positions. In addition, the workmen have to move around the pitch pans to be able to cover all four corners and sides; and, frequently, immediately-adjacent large pieces of equipment force the workmen to work in cramped quarters. Also, because the covering has to fit down inside of each wall of each pitch pan, the pitch pans must be made oversize to provide working room for the workmen's fingers between each wall and the object surrounded by each pitch pan. Additionally, the materials which are used to cover the pitch pans must be heated and stretched in more than one direction at each corner of each pitch pan. Further, the conditions of temperature, humidity and wind are beyond the control of the workmen. Moreover, the covered pitch pans cannot be picked up and examined to see if they are free from the cuts, tears or perforations that frequently are created during the covering of pitch pans on a roof. Furthermore, the materials which are used to cover the pitch pans are usually cut on the job, and hence can be cut inaccurately or ineptly. The overall result is that the practice of securing pitch pans to a roof and of then covering them with a material which is the same as, or similar to, the material used in covering the roof is objectionable. The present invention obviates that practice by providing a two-section pitch pan which is covered with water-impervious skirting before it is delivered to the job site. All an installer need do is to align the two sections of that pitch pan, secure them to each other and to the roof with fasteners, use a cement or adhesive to seal the skirting of those sections to the roof, use a cement or adhesive to seal an overskirt in position at each of the two sides of the pitch pan where the skirtings of the two sections confront each other, and then fill the filler-receiving recess defined by that pitch pan. Such a pitch pan can be installed quickly, easily and with complete certainty that it is free from the cuts, tears and perforations which have been noted in prior installations wherein the pitch pans were secured to the roofs and then subsequently covered. It is, therefore, an object of the present invention to provide a two-section pitch pan which is covered with water-impervious skirting before it is delivered to the job site.

Other and further objects and advantages of the present invention should become apparent from an examination of the drawing and accompanying description.

In the drawing and accompanying description, two preferred embodiments of the present invention are shown and described; but it is to be understood that the drawing and accompanying description are for the purpose of illustration only and do not limit the invention and that the invention will be defined by the appended claims.

DETAILED DESCRIPTION OF PREFERRED EMBODIMENTS

Figures 1, 2, 3, 4, 5:
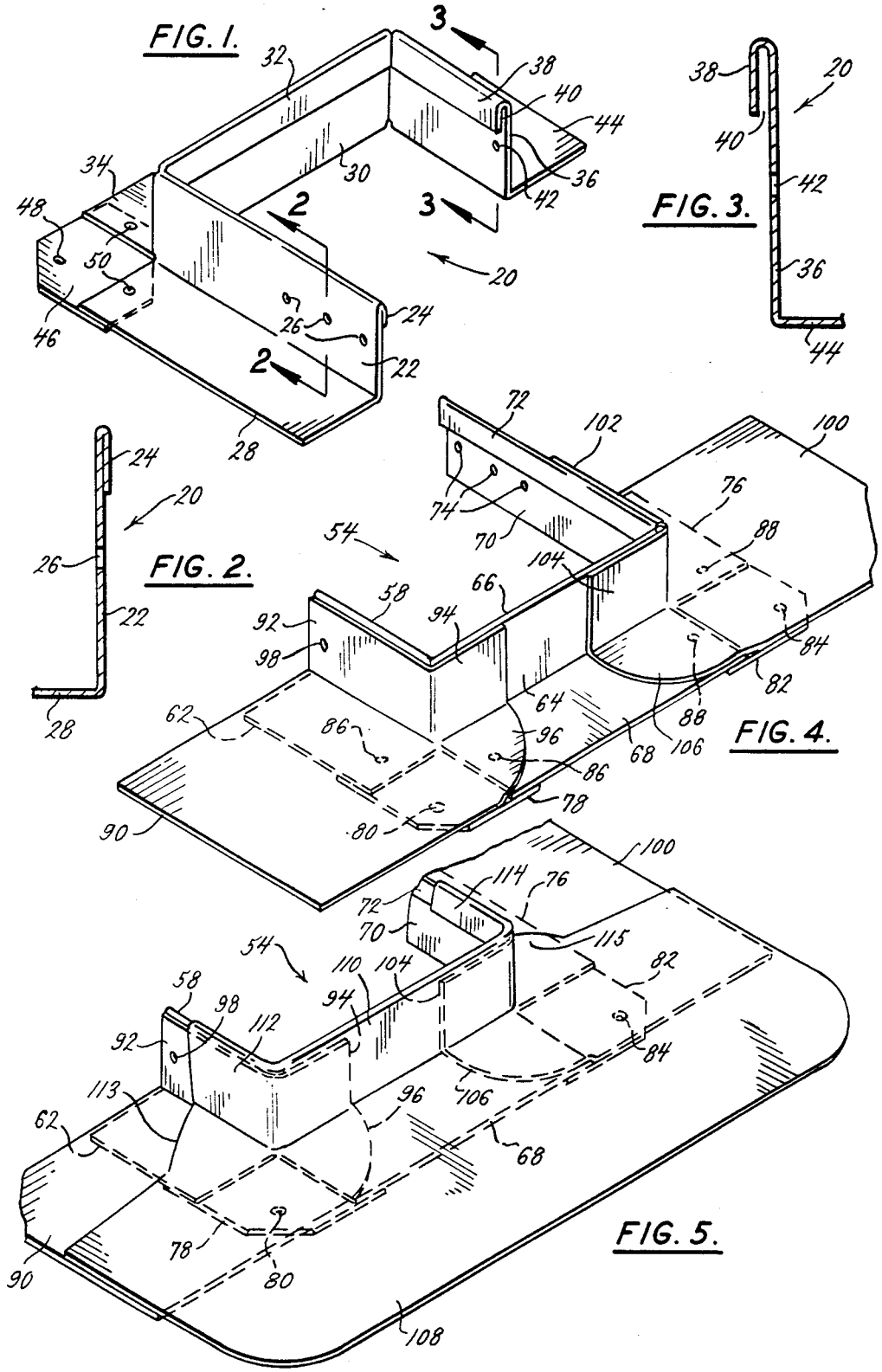
FIG. 1 is a perspective view, on a reduced scale, of one section of a two-section pitch pan which is made in accordance with the principles and teachings of the present invention.
FIG. 2 is a sectional view, on a larger scale, which is taken along a plane indicated by the line 2—2 in FIG. 1.
FIG. 3 is a sectional view, on the scale of FIG. 2, which is taken along a plane indicated by the line 3—3 in FIG. 1.
FIG. 4 is a perspective view, on the scale of FIG. 1, of part of the other section of the pitch pan after two underskirts have been conformed and adhered to that section.
FIG. 5 is a further perspective view of part of the section shown in FIG. 4 after the skirt for that section has been conformed and adhered to that section.

Referring particularly to FIGS. 1–7, the numeral 20 generally denotes one section of a two-section flash pan which is made in accordance with the principles and teachings of the present invention. That section has a long side wall 22 which has an inwardly and downwardly folded upper edge 24. Three small holes 26 are formed in that side wall adjacent the free end of that side wall. An outwardly bent flange 28 is provided at the bottom of the side wall 22; and that flange has a small hole, not shown, adjacent the left-hand end thereof.

The numeral 30 denotes the end wall of the section 20, and that end wall has an inwardly and downwardly folded upper edge 32. A flange 34 extends outwardly from the bottom of the end wall 32; and that flange has a small hole, not shown, adjacent each end thereof.

The numeral 36 denotes a short side wall for the section 20; and that short wall has an inwardly and downwardly folded upper edge 38 which defines an elongated recess 40 at the lower face thereof. A small hole 42 is provided in the wall 36 adjacent the free end of that wall; and that hole is spaced from the bottom of that wall the same distance by which the holes 26 are spaced from the bottom of the wall 22. A flange 44 projects outwardly from the bottom of the wall 36, and that flange has a hole, not shown, adjacent the left-hand end thereof. The long side wall 22, the end wall 30, and the short side wall 36 provide a generally J-shaped configuration for the pitch pan section 20.

The numeral 46 denotes a corner plate which has a side that can parallel the outer edge of the flange 28, and which has another side that can parallel the outer edge of the flange 34. The adjacent edges of those sides are connected by an inclined edge; and a small hole 48 is provided in the plate 46 adjacent that inclined edge. A fourth side of the plate 46 is parallel to that inclined edge; and fifth and sixth sides of that plate are parallel, respectively, to the first two sides. That corner plate has small holes, not shown, which can be disposed in register with the holes in the left-hand end of flange 28 and with the small hole in the adjacent end of flange 34. Rivets 50 are shown fixedly and tightly securing that corner plate to those flanges. A further corner plate, not shown, will be riveted to the opposite end of flange 34 and to the adjacent end of flange 44. That further corner plate will be a mirror image of the corner plate 46; and it will be fixedly and tightly secured to those flanges.

The pitch pan section 20 can be formed from metal by metal punching and folding operations; and, where so formed, it should be made of a gauge of metal which will make that section stiff and resistant to accidental bending. If desired, that pitch pan section could be molded from plastic, rubber or other suitable material. Where that section was molded, the corner plates 46 would be molded integrally with the rest of that section; and they would lie in the same planes in which the flanges 28, 34 and 44 lie. Also, where the section 20 was molded, the walls 22, 30 and 36 would be made thick enough, or would be suitably reinforced, to make that section stiff and resistant to accidental bending.

Figure 7:
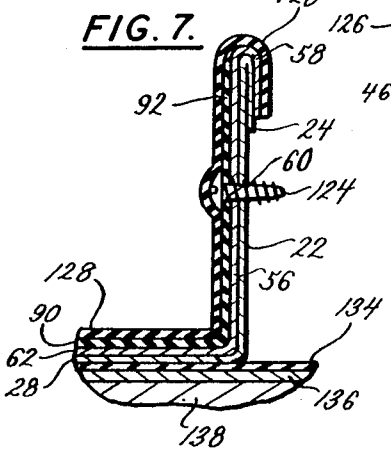
FIG. 7 is a sectional view, on the scale of FIG. 2, which is taken along a plane indicated by the line 7—7 in FIG. 6.
Figure 8:
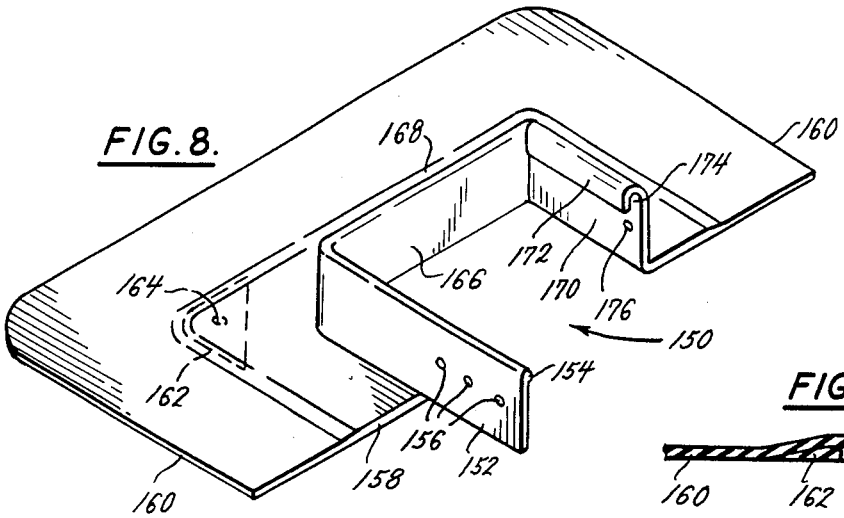
FIG. 8 is a perspective view, on a scale which is slightly smaller than that used in FIG. 1, of one section of a second preferred embodiment of pitch pan which is made in accordance with the principles and teachings of the present invention.
Figure 10:
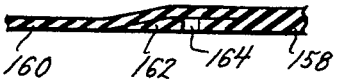
FIG. 10 is a sectional view, on a larger scale, which is taken along a plane indicated by the line 10—10 in FIG. 9.

The numeral 54 generally denotes a pitch pan section which is complementary to the section 20 shown by FIGS. 1–3. That section has a short side wall 56 which is shown in FIG. 7; and that wall has an inwardly and downwardly folded upper edge 58 which defines an elongated recess indicated by FIG. 7. A small hole 60 is provided in that wall close to the free end of that wall; and that hole is spaced from the bottom of that wall the same distance by which the holes 26 are spaced from the bottom of wall 22 of section 20, as shown in FIG. 7. A flange 62 projects outwardly from the bottom of the wall 56; and that flange has a small hole, not shown, adjacent the right-hand end thereof. The side wall 56 is dimensioned so the inwardly and downwardly folded upper edge 58 thereof can telescope over, and closely confine, the inwardly and downwardly folded upper edge 24 on side wall 22 of section 20.

The numeral 64 denotes the end wall for pitch pan section 54; and that end wall has an inwardly and downwardly folded upper edge 66. A flange 68 extends outwardly from the lower edge of end wall 64; and a small hole, not shown, is provided adjacent each end of that flange.

The numeral 70 denotes a long side wall for section 54; and the end wall 64 is dimensioned to dispose that long side wall in lapping relation with the side wall 36 of pitch pan section 20 whenever the side wall 56 of section 54 is in lapping relation with side wall 22 of section 20. An inwardly and downwardly folded upper edge 72 is provided for the wall 70; and three small holes 74 are provided in that wall adjacent the free end of that wall. Those holes are spaced from the bottom of wall 70 the same distance by which the hole 42 is spaced from the bottom of wall 36 of section 20. A flange 76 extends outwardly from the lower edge of wall 70; and that flange has a small hole, not shown, in the right-hand end thereof.

The section 54 is shown as being, and preferably will be, identical to the section 20. Where that is done, both sections can be made with just one set of tools, dies and fixtures, and hence can be made economically.

The numeral 78 denotes a corner plate which is substantially identical to the corner plate 46. That plate has a small hole 80 therein which is comparable to the hole 48 in the plate 46. The numeral 82 denotes a further corner plate which also is substantially identical to the plate 46; and it has a small hole 84 therein which is comparable to the hole 48. Rivets 86 fixedly and tightly secure the corner plate 78 to the flanges 62 and 68 of the section 54; and rivets 88 secure the corner plate 82 to the flanges 68 and 76 of that section. The section 54, like the section 20, can be formed from metal, plastic, rubber or other suitable material.

The section 54, like the section 20, will have a generally J-shaped configuration. The long side wall 70 of section 54 can be telescoped into partial lapping engagement with the short side wall 36 of section 20; and the short side wall 56 of section 54 can be telescoped into partially lapping engagement with the long side wall 22 of section 20. When those side walls are lapped, the elongated recess 40 defined by edge 38 on wall 36 will telescope down over and confine, and be confined by, the edge 72 on wall 70; and the elongated recess defined by the edge 58 on wall 56 will telescope down over and confine, and be confined by, edge 24 on wall 22. As a result, when the side walls of the sections 20 and 54 are lapped, the folded upper edges of those walls will serve as positioning surfaces which will cause those sections to define a rectangle.

The numeral 90 denotes an underskirt of resilient material, which preferably will be the same material that is used to cover the roof. In the preferred embodiment of FIGS. 1–7, that underskirt is made from synthetic rubber such as neoprene. That underskirt is initially made so it is rectangular in form; and one side edge thereof is aligned with the left-hand edge of flange 62 on pitch pan section 54 while the other side edge thereof is aligned with the outer edge of flange 68, as shown particularly by FIG. 4. The portion of underskirt 90 which overlies the flange 62 will be caused to fixedly adhere to that flange by a strong, quick-setting cement or adhesive. Once that portion of that underskirt has been solidly and tightly secured to that flange, a portion 92 of that underskirt will be adhered to the outer face of the short side wall 56—with the end edge of that underskirt close to the upper edge 58 of that wall. The right-hand end of the portion 92 will initially project outwardly beyond the end wall 64; and that right-hand end will be heated until it becomes readily extensible. The required heat will preferably be provided by a flow of hot air from a suitable air-heating device which can raise the temperature of the right-hand end of portion 92 to about one hundred and forty degrees Fahrenheit. Such a temperature will make that right-hand end sufficiently extensible and flexible to enable it to be stretched and bent into a portion 94 which can be adhered to wall 64 and also into a portion 96 which can be adhered to the flange 68, as shown particularly by FIG. 4. Although each corner of the underskirt 90 is initially rectangular, the portion 96 will have a generally arcuate periphery, and the free edge of portion 94 may be somewhat irregular in configuration—and may be inclined to the vertical. While the portions 94 and 96 are still heated, they will be tightly and firmly adhered to end wall 64 and to flange 68 by a strong, quick-setting cement or adhesive. After the underskirt 90 has been secured to side wall 56, to end wall 64, and to flanges 62 and 68, a small hole 98 will be formed in the portion 92 in register with the opening 60 in that side wall. It should be noted that the underskirt 90 will not be adhered to the corner plate 78. This can be accomplished by applying a piece of masking tape to the upper surface of that corner plate before the underskirt is adhered to the section 54, or by applying the cement or adhesive to that underskirt and to that section so none of that cement or adhesive reaches corner plate 78.

The numeral 100 denotes an underskirt which preferably is identical to the underskirt 90; and that underskirt is secured to the flange 76 so a portion 102 thereof abuts part of the outer surface of the long side wall 70. The side edges of that underskirt will be aligned with the edge of flange 68 and with the left-hand end of flange 76. After the underskirt 100 has been fixedly and tightly adhered to flange 76 and to wall 70, the right-hand end of portion 102 will project outwardly beyond end wall 76; and that right-hand end will be heated until it is readily extensible and bendable. That right-hand end will then be stretched and bent until a portion 104 thereof engages end wall 64 and a portion 106 thereof engages flange 68. While the portions 104 and 106 are still heated, they will be fixedly and intimately adhered to that end wall and to that flange. As the various portions of underskirt 100 are secured to flanges 68 and 76, to end wall 64 and to side wall 70, care will be taken to keep that underskirt from adhering to the corner plate 82. This can be done by applying masking tape to the upper surface of that corner plate before that underskirt is adhered to section 54, or can be done by carefully keeping cement or adhesive from reaching that corner plate.

The stretching and bending of the right-hand end of portion 92 to form the portions 94 and 96 of underskirt 90, and the stretching and bending of the right-hand end of portion 102 to form the portions 104 and 106 of underskirt 100, will reduce the thicknesses of portions 94, 96, 104 and 106 to about one-half of the initial thickness of the corresponding underskirt. However, even such reduced thicknesses will enable those portions to constitute positive and complete barriers to the passage of water, moisture or other materials. The stretching and bending of portions 92 and 102 to form portions 94, 96, 104 and 106 will be done under controlled conditions in a manufacturing facility; and tools, fixtures and jigs will be used which will enable the workman to have full visual and tactile access to section 54 and to underskirts 90 and 100. As a result, no cuts, tears or perforations will develop or form in any portion of the underskirts 90 and 100. The only hole in underskirt 90 will be the small hole 98 shown in FIG. 4; and the underskirt 100 will be devoid of holes. The underskirt 90 will yield slightly upwardly as it conforms to the upper surfaces of rivets 86; and similarly, the underskirt 100 will yield slightly upwardly as it conforms to the upper surfaces of rivets 88.

The numeral 108 denotes a skirt of generally T-shaped configuration; and that skirt, like the underskirts 90 and 100, will be made from a resilient material which preferably will be the same material that is used to cover the roof. The cross or arm portion of skirt 100 will overlie, and be adhered to, the central portion of flange 68, the portion 96 and the right-hand side of underskirt 90, and the portion 106 and right-hand side of underskirt 100. In addition, that cross or arm portion will project laterally outwardly beyond the right-hand edges of that flange and of those underskirts, as shown particularly by FIG. 5. The "stem" portion 110 of the skirt 108 is dimensioned to engage the central portion of end wall 64, the portion 94 of underskirt 90, and the portion 104 of underskirt 100, to extend upwardly beyond the upper edge 66 of that end wall, and also to extend outwardly beyond the ends of end wall 64. Cement or adhesive will be used to fixedly and tightly secure that "stem" portion to that central portion of end wall 64 and to portions 94 and 104, respectively, of the underskirts 90 and 100. Thereafter, the parts of the "stem" portion 110, which project outwardly beyond the ends of end wall 64, will be heated until they are readily extensible and bendable. Those parts will then be stretched and bent to form a portion 112 which laps parts of side wall 56 and of underskirt portion 92, a portion 113 which laps parts of flange 62 and of underskirt 90, a portion 114 which laps parts of side wall 70 and of portion 102 of underskirt 100, and a portion 115 which laps parts of flange 76 and of underskirt 100. While the portions 112, 113, 114 and 115 of skirt 108 are still readily extensible and bendable, they will be securely and tightly adhered to portion 92, underskirt 90, portion 102 and underskirt 100. Also, the upper edges of portions 110, 112 and 114 will be bent inwardly and downwardly over, and then tightly and fixedly adhered to, the upper edges of end wall 64, of portions 94 and 104, of portions 92 and 102, and of side walls 56 and 70.

As the sides of the "stem" portion 110 of skirt 108 are heated, stretched and bent to form the portions 112, 113, 114 and 115, no cuts, tears or perforations will develop or form in any portions of that skirt. Further, that skirt will be caused to have a water-tight seal between itself and underskirt 90 and underskirt 100, as well as between itself and end wall 64, flange 68 and the inwardly and downwardly bent edges 58, 66 and 72. Consequently, that skirt will coact with the underskirts 90 and 100 to provide a water-impervious cover which extends from the periphery of that skirt to the inner surfaces of the downwardly and inwardly folded upper edges 58, 66 and 72, respectively, of walls 56, 64 and 70. As the portions 112, 113, 114 and 115 are formed, the thicknesses thereof will be reduced to about one-half of the initial thickness of skirt 108. However, those stretched and bent portions will coact with the underlying portions of the underskirts 90 and 100 to provide a protective covering with a total thickness that is at least as great as the initial thickness of skirt 108.

Figure 6:
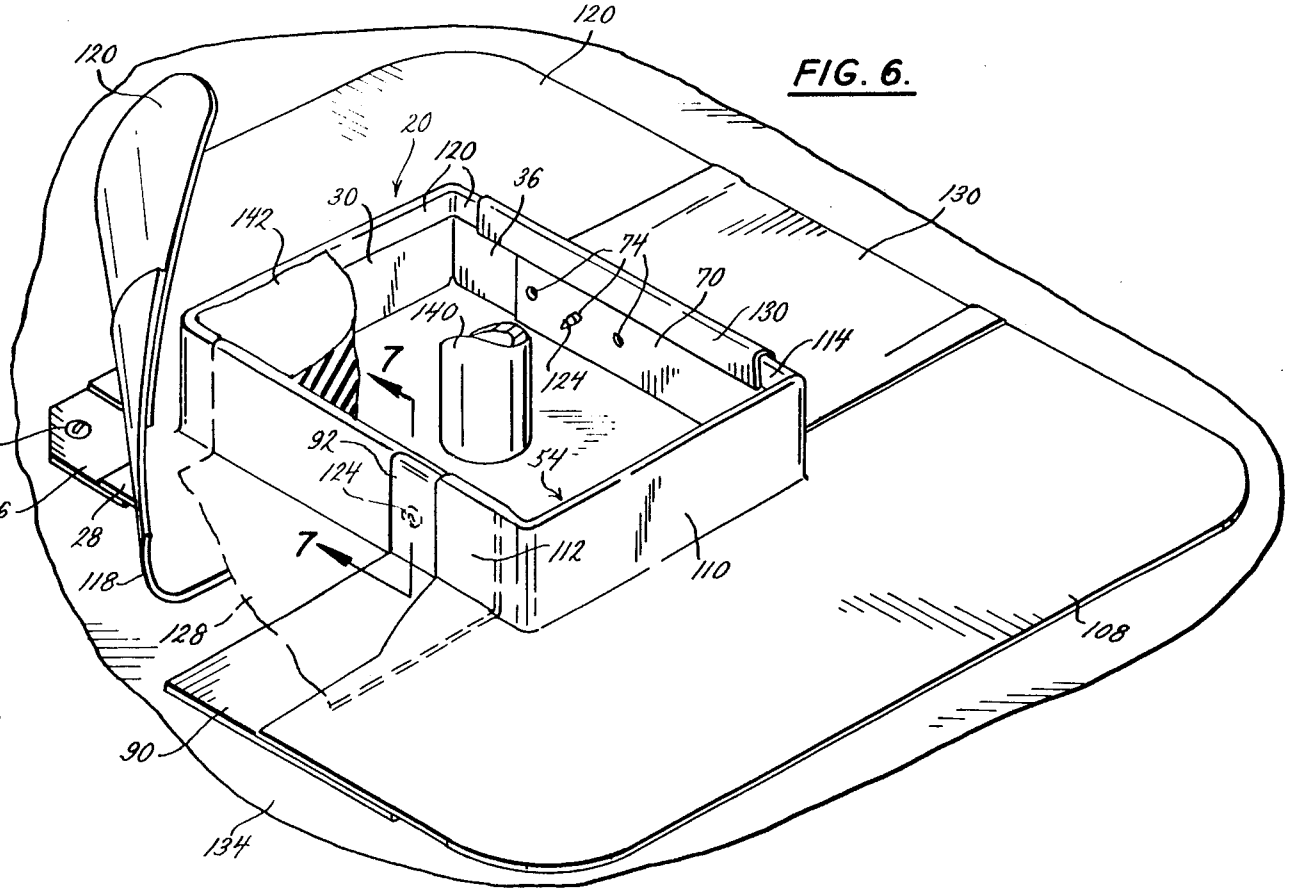
FIG. 6 is a perspective view, the scale of FIG. 1, of the pitch pan sections of FIGS. 1 and 4 after each of those sections has had two underskirts conformed and adhered thereto and also has had a skirt conformed and adhered thereto, after those sections have had the side walls thereof secured together, after those sections have been secured to a roof, and after overskirts have been secured to those sections. Those sections are shown surrounding an object which extends upwardly through the roof part of the filler which will be confined by those sections is shown, and part of one of the overskirts is shown by dotted lines.

As shown particularly by FIG. 6, the pitch pan section 20 will be provided with an underskirt 118 which will be a mirror image of the underskirt 90; and that section also will be provided with an underskirt, not shown, which will be a mirror image of the underskirt 100. After those underskirts have been fixedly and tightly adhered to that pitch pan section, a skirt 120, which will be a mirror image of the skirt 108, will be secured to that section. As shown particularly by FIG. 6, the upper edge of the "stem" section of that skirt will be folded inwardly and downwardly over the inwardly and downwardly folded upper edges 24, 32 and 38, respectively, of side wall 22, end wall 30, and side 36 of section 20. That skirt will coact with the underskirt 118 and with the underskirt, not shown, that is a mirror image of underskirt 100, to provide a water-impervious cover which extends from the periphery of that skirt to the inner surfaces of the downwardly and inwardly folded upper edges 24, 32 and 38.

The forming of pitch pan sections 20 and 54 will be done under controlled fabricating conditions; and hence those sections can be made with closely-held manufacturing tolerances. Similarly, the cutting of underskirts 90, 100, 118 and of the fourth underskirt, and the cutting of the skirts 108 and 120 will be done under controlled fabricating conditions; and hence all portions of the overall pitch pan skirting—constituted by those underskirts and skirts—can be made with closely-held manufacturing tolerances. In addition, the adhering of the underskirts and skirts to the pitch pan sections and to each other will be accomplished under controlled fabricating conditions; and hence those underskirts and skirts will be adhered to those pitch pan sections with precisely controlled relative positionings and with closely-held tolerances. Moreover, after those underskirts and skirts have been adhered to those pitch pan sections and to each other, those sections will be stored for a time and then given a final inspection before they are shipped. That storing and that final inspection are important in making certain that if the restorative forces developed in any of the stretched and bent portions of those skirts or underskirts were to pull loose, they could be tightly and fixedly adhered back in position before the pitch pan sections were finally shipped. All of this means that the pitch pan sections provided by the present invention are made with factory-controlled tolerances, are completely free of cuts, tears and perforations, and have time-tested bonds which permanently hold the underskirts and skirts in assembled relation with those sections.

When the pitch pan sections 20 and 54 are to be installed at a job site, the portion of the roof-covering membrane on which those sections are to be set will be carefully cleaned. Thereupon, those sections will be inverted so the bottoms of the underskirts and skirts are readily accessible; and then a strong adhesive or cement, of the type customarily used in the roofing trade to adhere a flashing to a roof-covering, will be applied to the undersurfaces of those underskirts and skirts, to the bottoms of flanges 28, 34, 44, 62, 68 and 76, and to the bottoms of the four corner plates. A temporary sheet-like spacer, which may be made as a split, open-center rectangle or as two U-shaped members, will be laid on the roof-covering in the area which will be subsequently occupied by the two pitch pan sections 20 and 54. That spacer will have a waxy or other non-adhering upper surface to which the adhesive or cement on the bottoms of the two sections will not readily adhere; and then those sections will be set atop that spacer so they surround an object which extends upwardly through the roof. One such object is shown in FIG. 6 and is denoted by the numeral 140.

At this time, the elongated recess 40 which is defined by the inwardly and downwardly bent upper edge 38 of side wall 36 of section 20 will be positioned over the inwardly and downwardly bent upper edge 72 of side wall 70 of section 54; and the elongated recess which is defined by the inwardly and downwardly bent upper edge 58 of side wall 56 of section 54 will be positioned over the inwardly and downwardly bent upper edge 24 of side wall 22 of section 20. The hole 60 in side wall 56, which is shown in FIG. 7, will be moved into register with one of the three holes 26 in side wall 22; and, simultaneously, the hole 42 in side wall 36 will be moved into register with a corresponding one of the holes 74 in side wall 70. Thereupon a fastener 124, which preferably will be a self-tapping metal screw, will be seated in the hole 60 and in the corresponding hole 26, while a further fastener 124 will be seated in the hole 42 and in the corresponding hole 74. Those fasteners will coact with the positioning surfaces constituted by the inwardly and downwardly folded upper edges 38 and 72 and by the inwardly and downwardly folded upper edges 24 and 58, and with the lapped side walls 22 and 56 and 36 and 70, to cause the pitch pan sections 20 and 54 to constitute an open-center, sturdy, filler-confining pitch pan which surrounds the object 140.

While the temporary spacer is in position beneath the pitch pan and its skirting, at least one corner of the skirt 120 will be raised, as shown by FIG. 6. Thereupon, a fastener 126 will be passed downwardly through the opening 48 in corner plate 36 and seated in the roof. Also, at least one corner of the skirt 108 will be raised upwardly to permit a similar fastener to be passed downwardly through opening 80 or opening 84 in corner plate 78 or 82, respectively, and seated in the roof. Those fasteners preferably will be wood screws; and those wood screws will solidly secure the pitch pan in position on the roof. At such time, the temporary spacer will be torn away from its position beneath that pitch pan and its skirting to cause the adhesive or cement on the undersurfaces of that pitch pan and skirting to engage the roof covering. A suitable roller or other pressure device will then be used to effect tight adhesion of that skirting to that roof covering, and to provide a water-tight engagement therebetween.

A generally rectangular skirt closure 128, which is shown by solid lines in FIG. 7 and by dotted lines in FIG. 6, will be used to overlie and adhere to the portions of the roof covering between the confronting edges of the underskirts 90 and 118; and also to overlie and adhere to the upper surfaces of those underskirts and the adjacent portions of skirts 108 and 120, as indicated particularly by FIG. 6. The inner end of that skirt closure will overlie, and be adhered to, the exposed part of the inwardly and downwardly folded upper edge 24 of side wall 22, and also to parts of the inwardly and downwardly folded upper edges of skirts 108 and 120. A similar skirt closure 130 will overlie and be adhered to the portions of the roof covering between the confronting edges of the underskirt 100 and of its counterpart on pitch pan section 20, will overlie and be adhered to the upper surfaces of those underskirts and the adjacent portions of skirts 108 and 120, and also will overlie and be adhered to the exposed part of the inwardly and downwardly folded upper edge 72 of side wall 70 and to parts of the inwardly and downwardly folded upper edges of skirts 108 and 120. As a result, those skirt closures will coact with underskirts 90, 100 and 118 and the underskirt on flange 44, and also with the skirts 108 and 120 to provide a continuous water-tight, corrosion-resistant, protective skirting from the peripheries of those underskirts, skirts and skirt closures to the inner faces of the folded upper edges of the walls of the pitch pan, as indicated by FIGS. 6 and 7.

The numeral 134 in FIG. 6 denotes the roof covering; and that roof covering can be a synthetic rubber membrane such as a neoprene membrane, can be a built-up roofing, or can be a modified bitumen roofing system. As a result, it should be clear that the pitch pan provided by the present invention can be used with substantially any kind of roof covering as long as that roof covering has a substantially planar surface on which the sections 20 and 54 and the skirtings thereon can be placed and then sealed in position. As indicated particularly by FIG. 7, the roof covering 134 can have an underlayer 136 beneath it which will rest upon the roof 138. The showing in FIG. 7 is merely intended to indicate one roofing arrangement with which the pitch pan is used, and that showing is not intended to indicate that the pitch pan is to be restricted to use with any specific kind of roofing system.

The numeral 142 in FIG. 6 denotes part of the filling material which will be introduced into the filler-confining recess that is formed by the sections 20 and 54. That filler material will provide a water-impervious seal with object 140, with walls 22, 30, 36, 56, 64 and 70, with the inwardly and downwardly folded edges 24, 32, 38, 58, 66 and 72 on those walls, with the inwardly and downwardly folded edges of skirts 108 and 120, and with the inwardly and downwardly folded edges of skirt closures 128 and 130. As a result, a completely water-tight enclosure surrounds and protects the joint where the object 140 passes upwardly through the roof covering 134.

Referring particularly to FIGS. 8–12, the numeral 150 generally denotes one section of a second preferred embodiment of plural-section pitch pan which is made in accordance with the principles and teachings of the present invention. That section has a long side wall 152 with a stiffening rib 154 at the upper edge thereof. Three small holes 156 are provided in the side wall 152 adjacent the free end of that side wall. A flange 158 projects horizontally outwardly from the lower edge of side wall 152; and the outer portion of that flange is denoted by the numeral 160. That outer portion is much thinner than the stiff inner portion of that flange; and hence that outer portion is readily flexible and is comparable to underskirt 118 and to the corresponding part of skirt 120 in FIG. 6. A securing tab 162 is provided at the corner of flange 158, and that securing tab has, or can have, a small hole 164 formed in it.

The numeral 166 denotes the end wall for the section 150; and that end wall has a reinforcing rib 168 at the upper edge thereof. A flange projects horizontally outwardly from the bottom of that end wall; and that flange has the same cross sections which the flange 158 and its outer portion 160 have.

The numeral 170 denotes a short side wall for the section 150; and that side wall has an inverted U-shaped upper edge 172 which defines an elongated recess 174 at its under surface. A small hole 176 is formed in that side wall adjacent the free end of that wall. That side wall has a flange projecting horizontally outwardly from the bottom thereof; and that flange has the same cross sections which the flange 158 and its outer portion 160 have. As a result, the section 150 has a continuous flange which projects horizontally outwardly from the bottoms of side wall 152, of end wall 166, and of side wall 170; and that flange and its outer portion 160 will coact with those side walls and that end wall to provide the continous waterproof protection which the underskirts and skirt of pitch pan section 20 provide.

The flange 158 has a further securing tab, not shown, adjacent the other corner thereof; and that securing tab can have a small hole therein. As shown particularly by FIG. 10, the securing tab 162 and the other securing tab, not shown, can be formed by providing a cleavage line between each such tab and the overlying portion of flange 158. The outer edges of those securing tabs will taper toward the lower surface of the flange 158. The pitch pan section 150 preferably is made by a molding process; and that section can be made from an artificial rubber, such as neoprene, from an elastomeric plastic which can withstand sun, rain and exposure to the elements, or from any other weater-resistant material which can be made stiff or readily flexible by changing its thickness. The securing tab 162 and its counterpart can be formed by providing the molding die with thin, triangular, forming plates; or they can be formed by subsequent cutting operations. If desired, the walls 152, 166 and 170 and the inner portion of flange 158 could be made quite stiff by providing them with sufficient thicknesses or by incorporating into them a reinforcing core of wire, fabric, plastic or the like. The outer portion 160 of flange 158 will be readily flexible, and hence can readily conform to a roof, in the same manner in which the skirt 120 of the section 20 of FIGS. 1–7 can readily conform to a roof.

Figure 12:
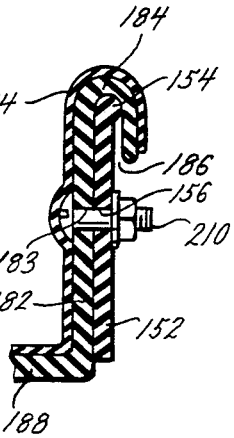
FIG. 12 is a sectional view, on the scale of FIG. 10, which is taken along a plane indicated by the line 12—12 in FIG. 11.
Figure 9:
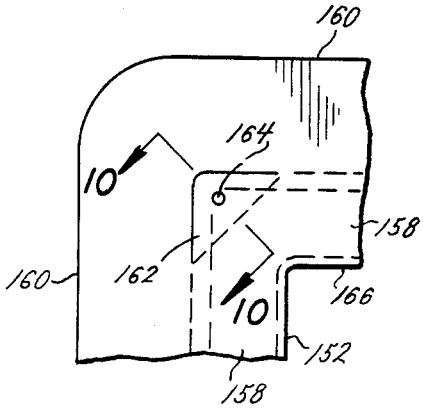
FIG. 9 is a plan view of a portion of one corner of the section shown in FIG. 8.

The numeral 180 generally denotes the other section of the plural-section pitch pan of FIGS. 8–12. That section has a short side wall 182 with a small hole 183 adjacent the free end of that wall. That wall has an inverted U-shaped upper edge 184 which defines an elongated recess 186 that is indicated by FIG. 12. A flange 188 projects horizontally outwardly from the bottom of side wall 182; and the outer portion of that flange is of reduced thickness and is denoted by the numeral 190. A securing tab 192 is provided at the corner of the flange 188; and that securing tab has a hole 194 therein.

Figure 11:
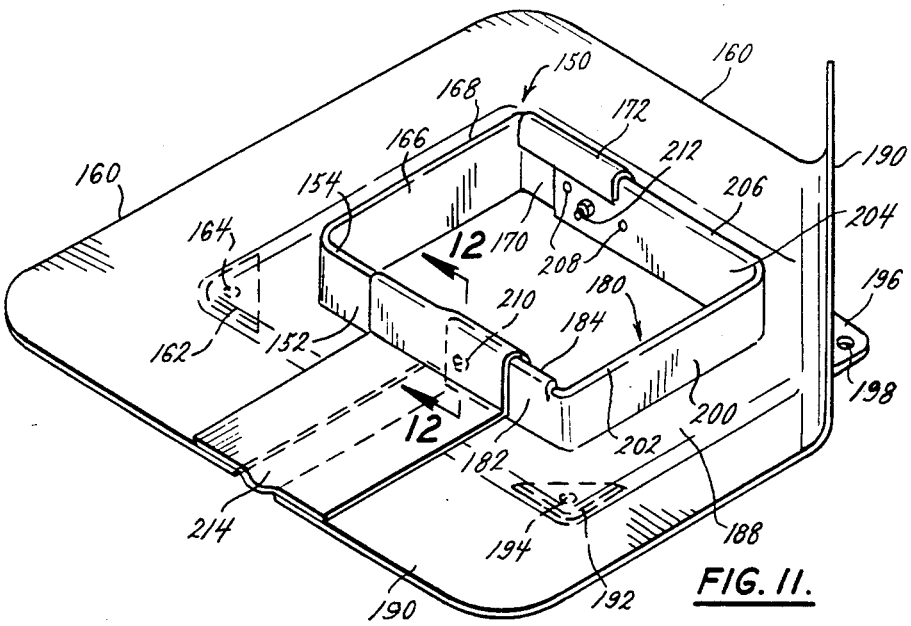
FIG. 11 is a perspective view, on the scale of FIG. 8, of the pitch pan section of FIG. 8 and of a complementary pitch pan section after those sections have been secured together and an overskirt has been adhered to those pitch pan sections; and it shows one corner of the skirting of the complementary pitch pan section raised to expose one of the securing tabs of that pitch pan section.

The numeral 200 denotes an end wall for the section 180; and that end wall has a reinforcing rib 202 at the upper edge thereof. Also, that end wall has a flange which projects horizontally outwardly from the bottom thereof; and that flange has the same cross section which the flange 158 and its outer portion 160 have. A securing tab 196 is formed at one corner of the portion of the flange which extends along the end wall 200, as shown by FIG. 11. A small hole 198 is provided in that securing tab.

The numeral 204 denotes a long side wall for section 180 which has three small holes 208 adjacent the free end of that wall. A reinforcing rib 206 is provided at the upper edge of that wall; and a flange projects horizontally outwardly from the bottom of that wall. That flange has the same cross section which the flange 158 and its outer portion 160 have. The sections 150 and 180 are shown as being, and preferably will be, identical. Where that is done, both of those sections can be made in the same mold.

The reinforcing rib 206 on the upper edge of long side wall 204 of section 180 is dimensioned to fit within, and to be positioned by, the elongated recess defined by the inverted U-shaped upper edge 172 on the wall 170 of section 150. Similarly, the reinforcing rib 154 on the upper edge of wall 152 of section 150 is dimensioned to fit within, and to be positioned by, the inverted U-shaped upper edge 184 on side wall 182 of section 180. Whenever the two sections 150 and 180 are assembled, the wall 152 will lap the wall 182, and the wall 170 will lap the wall 204. As a result, the two sections will provide a generally rectangular, sturdy, filler-confining recess around an object, not shown, which can extend upwardly through the roof. Those sections will be maintained with their walls in lapping arrangement by a fastener 210 which passes through the small holes 156 and 183, respectively, in the walls 152 and 182; and also by the fastener 212 which passes through the small holes 176 and 208. Those fasteners could have different forms; but they are shown in FIGS. 11 and 12 as being nut and bolt combinations.

Prior to the assembling of the sections 150 and 180, the bottom surfaces of the skirtings, constituted by flange 158 and its outer portion 160 and by flange 188 and its outer portion 190, will be coated with a suitable cement or adhesive. Thereafter, a temporary, sheet-like spacer, which has a waxy or other non-adhering upper surface to which that cement or adhesive will not readily adhere, will be placed on the roof on the area where the sections 150 and 180 are to be positioned. Thereupon, those sections can be set in position atop that spacer to surround the object which extends upwardly through the roof, the sides 152 and 182 can be lapped, the sides 170 and 204 can be lapped at the same time, and then the fasteners 210 and 212 can be used to secure those sections in assembled relation.

One of the corners of the reduced-thickness flange 160 can be raised upwardly so a fastener can be passed downwardly through the hole 164 in the securing tab 162 or through the corresponding hole in the other securing tab on that flange. Also, a corner of the reduced-thickness portion 190 of flange 188 can be raised, as shown in FIG. 11, to provide access to the opening 198 in the securing tab 196; and then a suitable fastener will be passed downwardly through that opening to help secure the plural-section pitch pan to the roof. If desired, fasteners could be passed downwardly through the holes in all four of the securing tabs; but it is usually sufficient to use fasteners in just two of those holes. Thereafter, the temporary spacer will be torn away; and a roller or other suitable pressure device will be used to force the adhesive or cement on the undersides of the flanges 158 and 188 and on their outer portions 160 and 190 into water-tight engagement with the roof covering.

At the completion of the rolling or pressing operation, the pitch pan will provide a recess which will confine filling material; and it will have skirtings which almost completely surround that recess. Each of the sections 150 and 180 has a mold-smooth outer surface which is continuous, uninterrupted, corrosion-resistant and water-impervious; and that surface extends from the outer periphery of that section to the inner walls of that section.

A skirt closure 214 will be adhered in position over the confronting edges of the portions of the skirtings in register with the side walls 152 and 182. Also, a further skirt closure, not shown, will be adhered in position over the confronting edges of the portions of the skirtings in register with the side walls 170 and 204. At such time, the sections 150 and 180, the skirtings thereof, and the skirt closures therefor will provide a continuous, water-impervious, corrosion-resistant surface which completely surrounds the object which extends upwardly through the roof. Also, that continuous, water-impervious, corrosion-resistant surface extends from the peripheries of those skirtings and skirt closures to the inner walls of the pitch pan. When the recess defined by the sections 150 and 180 is filled with a suitable filler, that filler will coact with that continuous waterproof surface to provide a completely water-tight joint where the object passes upwardly through the roof.

Whether the pitch pan sections of the present invention are made of metal or other material and then provided with skirtings as shown by FIGS. 1–7, or are molded with integrally-formed skirtings, the resulting pitch pan will provide a continuous, corrosion-resistant, and water-impervious surface which extends all the way from the outer peripheries of the skirtings and skirt closures to the inner surfaces of the recess defined by those sections. As a result, the present invention provides a plural-section pitch pan with skirtings therein which can be moved into position adjacent an object with precision and in a minimum amount of time. Further, the skirtings on those sections will be free of cuts, tears and perforations; and those skirtings will not come loose prior to, during, or after the introduction of filler material into the recess defined by those sections.

Whereas the drawing and accompanying description have shown and described two preferred embodiments of the present invention it should be apparent to those skilled in the art that various changes may be made in the form of the invention without affecting the scope thereof.

What I claim is:

1. A plural-section pitch pan that comprises a first pre-fabricated section which has skirting that is smoothly and intimately secured thereto as a integral part thereof, said section and said skirting thereof being movable as a unit into position on a roof adjacent an object that extends upwardly through said roof, said section having a plurality of relatively-stiff walls which are generally vertically directed and horizontally extending and which form a corner and which have interior and exterior faces and lower edges and said skirting overlying and concealing said corner and substantially all of said exterior faces, said section having the skirting thereof projecting outwardly from said lower edges of said walls and outwardly from said object before and after said section is disposed on said roof, said skirting having a periphery which is spaced outwardly from said walls of said section, said skirting having flexible outer portions that are adjacent said periphery and that are readily conformable and readily adherable to said roof, said skirting providing a continuous, corrosion-resistant, water-impervious surface from said periphery of said skirting to said interior faces of said walls, a second pre-fabricated section which has skirting that is smoothly and intimately secured thereto as an integral part thereof, said second section and said skirting thereof being movable as a unit into position on said roof adjacent said object, said second section having a plurality of relatively-stiff walls which are generally vertically directed and horizontally extending and which form a corner and which have interior and exterior faces and lower edges and said skirting overlying and concealing said corner and substantially all of said exterior faces, said second section having the skirting thereof projecting outwardly from said lower edges of said walls and outwardly from said object before and after said second section is disposed on said roof, said skirting on said second section having a periphery which is spaced outwardly from said walls of said second section, said skirting on said second section having flexible outer portions that are adjacent said periphery and that are readily conformable and readily adherable to said roof, said skirting on said second section providing a continuous, corrosion-resistant, water-impervious surface from said periphery of said skirting to said interior faces of said walls of said second section, said sections having portions of said walls thereof engageable with each other to lap and thereby cause said sections to define a filling-confining recess around said object whenever said sections are disposed on said roof adjacent said object, said skirting on said first section having edges which are disposable close to edges of said skirting on said second section whenever said portions of said walls of said sections are in lapping relation, whereby said sections can receive and confine filling around said object and also can be sealed to said roof in substantially water-tight engagement throughout the entire lengths of said peripheries of said skirtings on said sections.

2. A plural-section pitch pan as claimed in claim 1 wherein said sections are mirror images of each other, wherein said sections have positioning surfaces on some of said walls thereof, wherein the positioning surface on one wall of said one section telescopes over a positioning surface on one wall of said second section, and wherein the positioning surface on another wall of said second section telescopes over the positioning surface on another wall of said one section.

3. A plural-section pitch pan as claimed in claim 1 wherein said sections are mirror images of each other, wherein said sections have positioning surfaces on some of said walls thereof, wherein the positioning surface on one wall of said one section telescopes over a positioning surface on one wall of said second section, wherein the positioning surface on another wall of said second section telescopes over the positioning surface on another wall of said one section, and wherein said positioning surfaces can guide said sections for movement relative to each other while said portions of said walls of said sections are in said lapping relation.

4. A plural-section pitch pan as claimed in claim 1 wherein each of said sections is generally J-shaped to have a long wall and a short wall and an intermediate wall, wherein a portion of said long wall of said one section can lap a portion of said short wall of said second section, wherein a portion of said long wall of said second section can lap a portion of said short wall of said one section, wherein positioning surfaces on said short and long walls can hold portions of said long and short walls in said lapping relation, and wherein said long, short and intermediate walls of just two J-shaped sections can completely surround said object that extends up through said roof.

5. A plural-section pitch pan as claimed in claim 1 wherein said walls of said one section are formed and then said skirting for said walls is stretched and bent and adhered to said walls to provide a readily-handled readily-transported, skirting-equipped pre-fabricated section, and wherein said walls of said second section are formed and then said skirting for said walls is stretched and bent and adhered to said walls to provide a second readily-handled, readily-transported, skirting-equipped pre-fabricated section.

6. A plural-section pitch pan as claimed in claim 1 wherein a positioning surface on said one section projects beyond said skirting on said one section, and wherein a positioning surface on said second section projects beyond said skirting on said second section.

7. A plural-section pitch pan as claimed in claim 1 wherein said walls and said skirting of said one section have a mold-smooth, continuous, uninterrupted and water-impervious surface which extends from said periphery of said skirting to said interior faces of said walls, and wherein said walls and said skirting of said second section have a mold-smooth, continuous, uninterrupted and water-impervious surface which extends from said periphery of said skirting to said interior faces of said walls.

8. A plural-section pitch pan as claimed in claim 1 wherein said walls and said skirting of said one section have a mold-smooth, continuous, uninterrupted and water-impervious surface which extends from said periphery of said skirting to said interior faces of said walls, wherein said walls and said skirting of said second section have a mold-smooth, continuous, uninterrupted and water-impervious surface which extends from said periphery of said skirting to said interior faces of said walls, wherein portions of said skirting adjacent said periphery of said skirting on said one section are thinner than other portions of said skirting to make said portions readily flexible and readily conformable to said roof, and wherein portions of said skirting adjacent said periphery of said skirting on said second section are thinner than other portions of said skirting to make said portions readily flexible and readily conformable to said roof.

9. A plural-section pitch pan as claimed in claim 1 wherein at least one of said sections has a securing portion which is displaced outwardly relative to the walls of said section and which is disposable adjacent said roof to be mechanically secured to said roof by a fastener, wherein said skirting on said section normally overlies, conceals and protects said securing portion but has a part thereof which can be raised upwardly and away from said securing portion to permit said fastener to secure said securing portion to said roof, and wherein said part of said skirting is moveable back into position adjacent said securing portion to overlie, conceal and protect said securing portion and said fastener.

10. A plural-section pitch pan that comprises a first pre-fabricated section which is disposable on a roof adjacent an object that extends upwardly from said roof, a second pre-fabricated section which is disposable on said roof adjacent said object, each of said sections having three relatively-stiff walls that are vertically directed and horizontally extending whenever said sections are disposed on said roof, two of said walls of each section being side walls that are opposed to each other and that are spaced apart by an end wall, one side wall of each of said sections being shorter than an opposed side wall of said section to make said sections generally J-shaped in plan, one of said side walls of each of said sections having an upper edge which is formed to define a downwardly-opening recess and the opposed side wall of said section having an upper edge which is dimensioned to fit within such a downwardly-opening recess, said one side wall of said first section being disposable in register with said opposed side wall of said second section and said opposed side wall of said first section being disposable in register with said one side wall of said second section when said sections are disposed on said roof in position to enclose said object, said downwardly-opening recesses on said one side walls and said upper edges on said opposed side walls of said sections acting as positioning surfaces which permit said side walls of said sections to lap each other to varying extents and thereby provide a plurality of potentially-different sizes of filler-receiving recess surrounding said object, said end walls of said sections being equal in length to facilitate automatic positioning of said opposed side wall of said first section in register with said one side wall of said second section whenever said one side wall of said first section is disposed in register with said opposed side wall of said second section.

11. A plural section pitch pan as claimed in claim 10 wherein said positioning surfaces hold said one side wall of said first section in close face-to-face relation with said opposed side wall of said second section while holding said opposed side wall of said first section in close face-to-face relation with said one side wall of said second section, whereby just one fastener passing through said one side wall of said first section and said opposed side wall of said second section and just one fastener passing through said opposed side wall of said first section and said one side wall of said second section can coact with said face-to-face relations to hold said sections in rigid relation to each other.

12. A plural-section pitch pan as claimed in claim 10 wherein said sections provide a lapped joint at one side of said filling-receiving recess, provide a second lapped joint at said opposed side of said filling-receiving recess, and provide joint-free continuous walls between said two lapped joints.

* * * * *